US005525750A

United States Patent [19]

Beller

[11] Patent Number: 5,525,750

[45] Date of Patent: Jun. 11, 1996

[54] HUMBUCKING PICKUP FOR ELECTRIC GUITAR

[75] Inventor: Kevin J. Beller, Santa Barbara, Calif.

[73] Assignee: Carter Duncan Corp., Santa Barbara, Calif.

[21] Appl. No.: 383,896

[22] Filed: Feb. 6, 1995

Related U.S. Application Data

[63] Continuation-in-part of Ser. No. 87,991, Jul. 2, 1993, abandoned.

[51] Int. Cl.[6] ..... G10H 3/18

[52] U.S. Cl. ..... 84/726; 84/728

[58] Field of Search ..... 84/723, 725, 726, 84/728

[56] References Cited

U.S. PATENT DOCUMENTS

| | | | |
|---|---|---|---|
| 4,026,178 | 5/1977 | Fuller | 84/726 |
| 4,581,974 | 4/1986 | Fender | 84/725 |
| 5,111,728 | 5/1992 | Blucher et al. | 84/726 |
| 5,292,998 | 3/1994 | Knapp | 84/726 |

*Primary Examiner*—William M. Shoop, Jr.
*Assistant Examiner*—Jeffrey W. Donels
*Attorney, Agent, or Firm*—Gene W. Arant

[57] ABSTRACT

A humbucker pickup for creating electrical signals indicative of the string vibrations of an electric guitar includes a matched pair of elongated coil assemblies and a transversely polarized permanent magnet disposed between and parallel to the coils. Each coil assembly includes a flat vertically oriented core plate which is reduced to partial height in one portion of its length. The core structures are disposed parallel to each other but with the partial height portions of the core plates at opposite ends of the respective core structures. Under each string of the instrument the full-height portion of one core plate forms a tall pole piece adjacent the string for concentrating the magnetic field through the string, while the reduced-height portion of the other core plate forms a short pole piece spaced away from the string.

14 Claims, 6 Drawing Sheets

SINGLE COIL STRAT
FLUX FIELD

CONVENTIONAL HUMBUCKER
FLUX FIELD

HOT RAILS
FLUX FIELD

VINTAGE RAILS
FLUX FIELD

HUMBUCKING PICKUP FOR ELECTRIC GUITAR

RELATED APPLICATION

This application is a continuation-in-part of my prior copending application Ser. No. 08/087,991 filed Jul. 2, 1993 which is now abandoned.

GENERAL BACKGROUND INFORMATION

When the strings of an electric guitar are plucked, sound waves are generated in the air and electrical signals are also created in an associated electrical circuit. The vibrations of the strings, which are made of a magnetically permeable metallic material, induce signals in a device known as a pickup. The pickup is positioned underneath the strings of the instrument in the upper plate. The pickup operates on an electromagnetic principle and provides a signal to an output circuit.

The most essential components of a guitar pickup are a permanent magnet and a coil of wire. The magnet generates a magnetic field that passes through the pickup coil and also extends into a space occupied by at least one string of the instrument. Vibration of the string changes the reluctance of the magnetic path and creates disturbances in the magnetic field proportional to the string vibration. The changing magnetic field in the pickup coil in turn induces an electrical signal in the coil. From the output of the pickup a circuit connection is made to an amplifier and speaker system. Impedance matching in the electrical system may be required to transfer the music signal effectively.

The energy level of the string vibration is very small and design of the pickup is calculated to obtain maximum signal output. Pickups often include a pole piece in addition to the permanent magnet so as to concentrate the magnetic field where it is most needed and thus maximize the output signal.

In a musical performance the direct sound output of the electric guitar—i. e., its acoustical output—is so low that it does not add appreciably to sound output originating from a pickup or pickups that is disseminated through an amplifier and loudspeakers. In some instances an artist may wish to make a recording using only the sound output developed in the electrical system. Regardless of which way a performance or recording is to be handled, the fact remains that a high quality of musical sound output from each pickup is required.

The magnetic field of the pickup necessarily constitutes a load on an associated string, causing some damping or diminution in the string vibration. As a result, there may be some non-linearity with consequent distortion and loss of quality in both the acoustical sound output and the electrical sound output. Guitar musicians may differ, however, in their evaluation of musical quality, and in some instances a certain amount of distortion of a pure musical sound may be preferred.

As is well known, string vibrations occur at multiple frequencies—that is, a string that is vibrating at a certain fundamental frequency is concurrently vibrating at two, three, four, etc., times that fundamental frequency. At these higher overtone frequencies the length of each vibrating string segment becomes quite small. Thus, the vibrations of a string at different locations along its length will be out of phase with each other for some frequencies. If a dual pickup coil detects different portions of the string vibration that are out-of-phase with each other, the result will be a significant loss of signal strength at the corresponding frequencies.

The guitar is an instrument with six strings, each having its own assigned frequency. Theory might indicate that there should be a separate pickup for each string. However, practical cost considerations have resulted in the practice of using an elongated coil that can pick up vibration signals from all of the strings at once. The coil is made long enough to span all six of the strings and is positioned with its longitudinal axis essentially perpendicular to the length of the strings.

In every pickup coil a certain number of turns are needed in order to effectively respond to the changes in the magnetic field; i.e., to produce a useful output signal in response to the string vibration. Providing a coil with the desired number of turns necessarily results in inductance, resistance, and capacitance. For a given wire size the resistance of the coil is essentially proportional to the length of the wire and hence to the number of turns in the coil. The same is true for the capacitance. Changes in wire size and number of turns may result in a change in the musical character of the sound output that would not be acceptable to musicians using the instruments.

A well-known problem of the electric guitar is that the pickup coil, in addition to its desired function of picking up string vibrations, also tends to pick up electrical noise and interference signals from various extraneous sources, such as power circuits, radio and television equipment, and the like. It has long been well known to utilize a two-coil pickup in which the coils are interconnected in such a way as to balance out the extraneous signals. Such pickups are known in the trade as "humbuckers".

The operating principle of the humbucker is that the two coils are connected in opposite electrical polarities so that the noise signals which are electrically induced in them will cancel each other out. At the same time, the magnetic circuits of the humbucker's two coils are so arranged that the signals magnetically induced in them from the string vibrations will be added together rather than being cancelled. An important requirement for a humbucker is that the electrical impedances of the two coils must be substantially identical. Otherwise the noise signals induced in the two coils will be unequal and will not completely cancel out.

BACKGROUND OF THE INVENTION

Electric guitar instruments are made with special cavities in the upper plate to receive pickups. A leading example is the well-known Stratocaster guitar manufactured by the Fender company, which has three separate cavities each of which will receive a single-coil pickup. Since a conventional humbucker pickup occupies twice as much space as the conventional single-coil pickup, the use of humbuckers for instruments of that type has been restricted accordingly.

However, Carter Duncan Corp. dba Seymour Duncan Co. has previously made and sold under the name "Hot Rails" a humbucker pickup of compact size that fits into the standard cavity for a single-coil pickup.

The object and purpose of the present invention is to provide a humbucker of compact size that fits into the standard cavity for a single-coil pickup, that picks up the vibrations of only a very short length of the string, and that has greatly improved sensitivity and a high quality output signal.

SUMMARY OF THE INVENTION

According to the invention a humbucker pickup for an electric guitar includes a matched pair of elongated pickup coils, a transversely polarized permanent magnet disposed between and parallel to the coils, and associated core structures for the coils which are so arranged as to narrow the magnetic field applied to the associated strings. More specifically, the core structure for each coil is made deliberately unsymmetrical on its two ends, and the two core structures are placed parallel to each other but in reverse symmetry. One end of each core structure extends close to the strings while the associated end of the other core structure does not. This results in a narrowing of the magnetic field aperture applied to the strings, while also maintaining substantially identical impedances of the two coils.

According to another feature of the invention a pickup that includes a slotted metal core plate with a screw forming a pole piece and adjustably seated in its slot is improved by angling the edge of the core plate away from both sides of the slot so as to concentrate the magnetic field in the screw itself.

DESCRIPTION OF THE PRIOR ART

Figure 1:
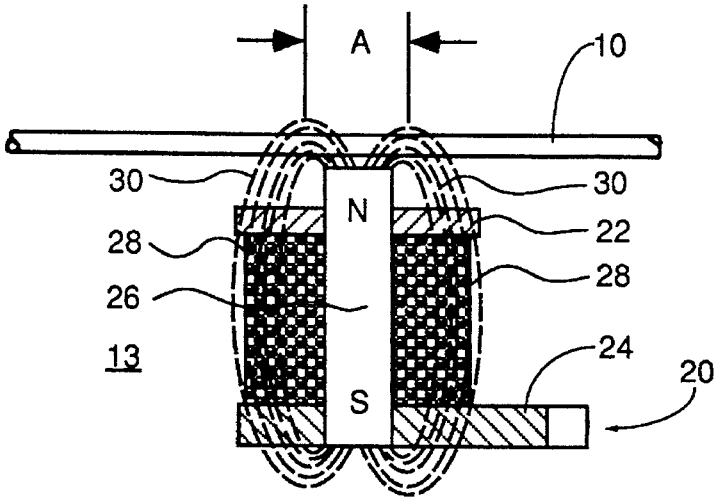
FIG. 1 PRIOR ART
FIG. 1 is a cross-sectional elevation view of a conventional single coil pickup showing the interaction of the magnetic field with the strings above it.

FIG. 1 illustrates a conventional single-coil pickup 18, which may for example be of the type known as the "Strat" or "Stratocaster" pickup. An elongated bobbin 20 shown in cross-section and made of a non-magnetic insulating material has a flat upper shelf 22 and a flat lower shelf 24. A central gap in the bobbin is occupied by a vertically extending permanent magnet 26, having defined North and South poles at its upper and lower ends, respectively. The elongated coil 28 typically consists of thousands of loops of fine copper magnet wire, fills both sides of the bobbin, surrounds the magnet, and is positioned underneath and transverse to strings 10. Lines of force 30 indicate the magnetic field that emanates from magnet 26 into both sides of the coil and interacts with the strings 10 of the instrument.

The magnetic reluctance of the magnetic pathway is diminished by the presence of strings 10, which are made of a magnetizable material. Movement of the strings 10 modifies or modulates the magnetic field. The string movements are therefore reflected in electric voltages induced in the single coil.

While a particular polarity is shown for the magnet of FIG. 1, the polarity may be reversed without affecting the operation. Rather than a single elongated magnet the prior art has typically utilized a spaced series of magnet rods, each being then positioned beneath a corresponding string of the instrument. In such a series of magnets, all are of the same polarity.

In connection with FIG. 1 it should be noted that the width or aperture of the magnetic field that is applied to strings 10 is indicated by horizontal arrows above the strings and the letter "A" for aperture.

Figure 2:
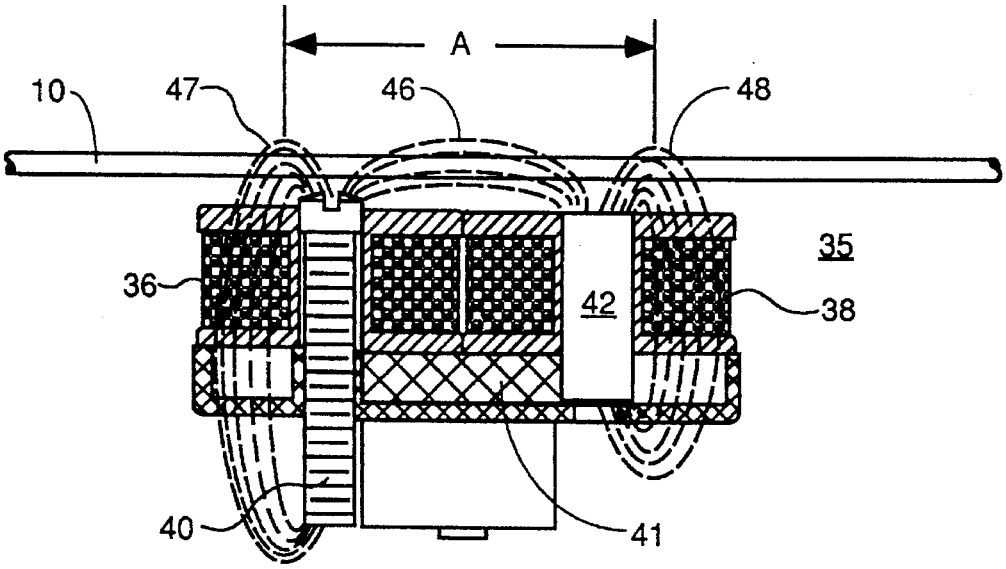
FIG. 2 PRIOR ART
FIG. 2 is a cross-sectional elevation view of a conventional two-coil humbucker pickup showing the interaction of the magnetic field with the strings above it.

FIG. 2 illustrates a conventional humbucker pickup. The pickup 35 has two parallel coils 36, 38, which are positioned underneath and transverse to strings 10. A row of adjustable pole pieces 40, only one of which is shown, extend vertically through the windings of coil 36. Similarly, a row of fixed pole pieces 42 extend vertically through the windings of coil 38. A transversely polarized permanent magnet 41 engages both rows of pole pieces. If pole pieces 40 have a north pole on their upper ends, the upper ends of pole pieces 42 must then have south poles, or vice versa. The main pathway of lines of magnetic force between the pole pieces 40, 42 is designated by numeral 46, and includes plural lines of force extending from the top of pole pieces 40 and through the area occupied by strings 10 and hence to the top of the pole pieces 42. Branch lines of force passing through the outer portions of coils 36, 38, are indicated by numerals 47, 48.

In connection with FIG. 2 it wll be noted that the width or aperture of the magnetic field that is applied to strings 10 is again indicated by horizontal arrows above the strings and the letter "A" for aperture. The magnetic field aperture of the humbucking pickup of FIG. 2 is approximately twice as wide as that for the single coil pickup of FIG. 1, and therefore responds to the vibrations of about twice as much of the string length.

In the humbucking pickup of FIG. 2 the movement of the strings 10 induces corresponding voltage signals in both of the coils. In accordance with conventional practice the two coils are electrically connected in additive relation with respect to the magnetically created music signals and in cancelling relation with respect to inductively received external noise signals.

Figure 3:
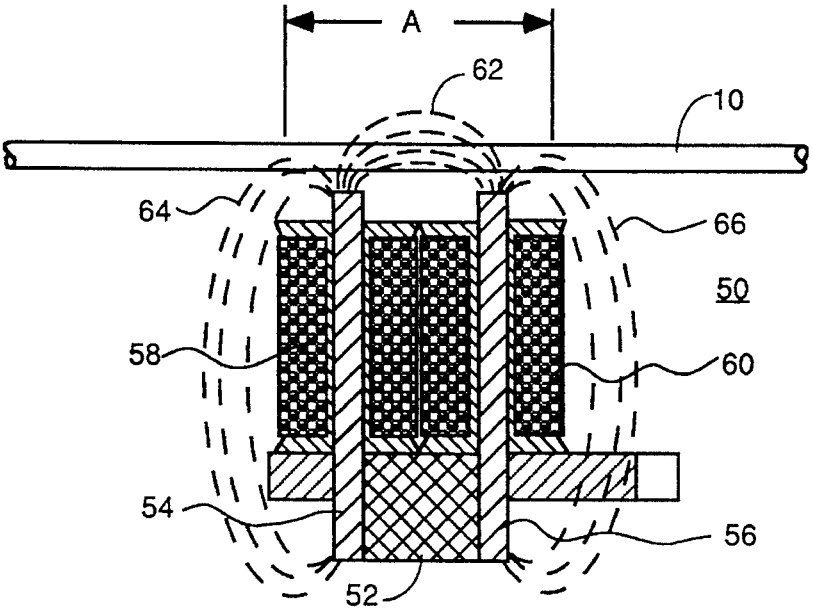
FIG. 3 PRIOR ART
FIG. 3 is a cross-sectional elevation view of a humbucker pickup previously manufactured and sold by Seymour Duncan, having rail-shaped cores, showing the interaction of the magnetic field with the strings above it.

FIG. 3 represents the type of humbucker pickup 50 which has been previously sold by Seymour Duncan under the name "Hot Rails". It includes pole pieces as well as a permanent magnet. The permanent magnet 52 is a transversely polarized flat bar, which has a north pole N on one side and a south pole S on the other side. Two pole pieces 54, 56, are flat strips or rails of magnetizable metal which have their width extending vertically, the two pole pieces being disposed in parallel relation on opposite sides of the magnet 52. The flat side face of the left edge of magnet 52 directly engages the lower inside surface of rail 54, and the flat side face of the right edge of magnet 52 directly engages the lower inside surface of rail 56. A coil 58 is wound about the rail 54 and a coil 60 is wound about the rail 56. The magnetic lines of force 62, 64, 66, pass through strings 10 in the same manner as for the conventional humbucker pickup of FIG. 2.

The flat rail pole pieces 54, 56 as shown in FIG. 3 require a lesser amount of space than rod magnets. By also restricting the thickness of the windings it is possible to fit the humbucker 50 into a cavity that was made for a single-coil pickup. The width or aperture of the magnetic field that is applied to strings 10 is again indicated in FIG. 3 by horizontal arrows above the strings and the letter "A" for aperture. It will be noted that the magnetic field aperture of the humbucking pickup of FIG. 3 is narrower than that for the conventional humbucker of FIG. 2, but wider than that for the single coil pickup of FIG. 1.

DETAILED DESCRIPTION OF PREFERRED EMBODIMENT

A humbucker pickup for an electric guitar according to the present invention includes a matched pair of elongated coil assemblies placed closely in parallel, an electrical circuit connecting the two coils with opposing electrical polarities so that external noise signals are cancelled, and magnetic circuits of the two coils arranged in opposite sense so that music signals magnetically created in the coils are added, all as taught in the prior art. A novel feature of the invention provides associated core structures for the coils that are so arranged as to narrow the magnetic field applied to the strings of the instrument. More specifically, the core structures for the two coils are made deliberately unsymmetrical at their two ends, and the two core structures are placed parallel to each other but in reverse symmetry. One end of each core structure extends close to the strings while the associated end of the other core structure does not. This results in a narrowing of the magnetic field aperture applied to the strings, while also maintaining substantially identical impedances of the two coils.

Figure 4:
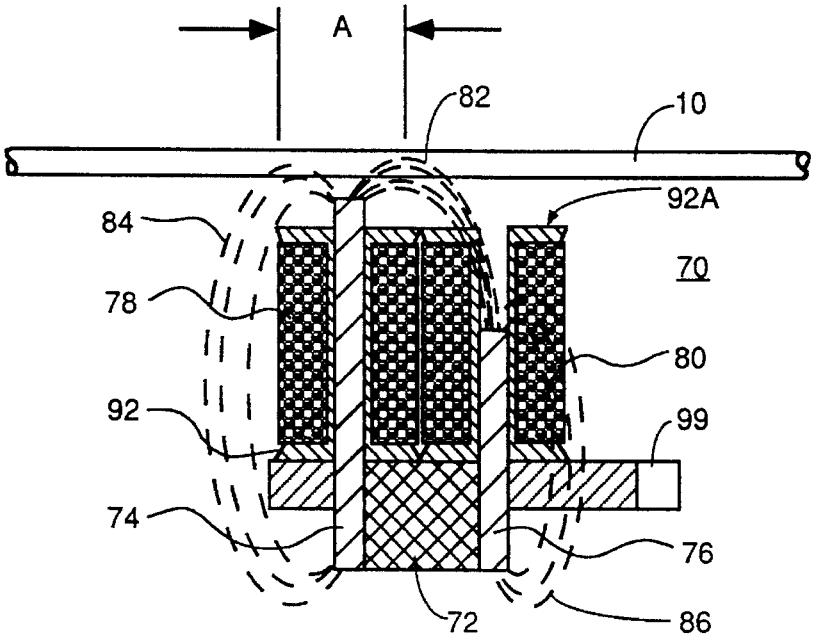
FIG. 4 is a cross-sectional elevation view of the presently preferred embodiment of the present invention, taken on the line 4—4 of FIG. 7, and showing the interaction of the magnetic field with the strings above it.

The presently preferred embodiment of the invention is illustrated in FIGS. 4 through 8, inclusive. FIG. 4 is a cross-sectional elevation view taken on the line 4—4 of FIG. 7, and showing the interaction of the magnetic field with the strings above the pickup. The pickup 70 includes pole pieces as well as a permanent magnet. Magnet 72 in the form of a flat bar is an elongated, transversely polarized permanent magnet with a north pole N on one side and a south pole S on the other side. Two elongated flat plates or rails 74, 76, of magnetizable metal are arranged with their width dimension extending vertically, thus providing their height, and are disposed in parallel relation on opposite sides of the magnet 72. The flat side face of the left edge of magnet 72 directly engages the lower inside surface of plate or rail 74, and the flat side face of the right edge of magnet 72 directly engages the lower inside surface of plate or rail 76. A coil 78 is wound about the rail 74 and a coil 80 is wound about the rail 76.

According to the invention tall pole pieces are formed on each side of the magnet by a single elongated plate which also has a reduced height portion to form an associated short pole piece. There are at least two pairs of relatively tall pole pieces and two pairs of relatively short pole pieces, one end of the tall pole pieces of one pair and one end of the short pole pieces of one pair engaging opposite sides of one end of the magnet, and one end of the tall pole pieces of the other pair and one end of the short pole pieces of the other pair engaging opposite sides of the other end of the magnet.

A pair of substantially identical pickup coils are each wound about a corresponding elongated plate on one side of the magnet, in such direction that the two coils are magnetized in opposing polarity, and so that the magnetic field generated from each set of two oppositely arranged pole pieces is concentrated adjacent the coil wound about the tall pole piece of that set. The operation of one such set of pole pieces is shown in FIG. 4.

In the pickup 70 as shown in FIG. 4 the rail 74 extends vertically all the way through its associated coil 78, and somewhat above it. Rail 76, however, is only about half as high as rail 74 and, since its lower edge is flush with the lower edge of magnet 72, its upper edge terminates at about the vertical center of the associated coil 80. As a result, the magnetic field is greatly distorted by comparison to the field of FIG. 3.

In FIG. 4 the magnetic lines of force 84 pass through strings 10 in the same manner as the lines of force 64 in the pickup of FIG. 3. Here the analogy ends. Lines of force 82 shown as emanating from the top edge of rail 74 then veer sharply downward to enter the top edge of the shortened or depressed rail 76. Magnetic lines of force 86 also pass from the upper edge of rail 76 and through the outer part of coil 80 to enter the bottom edge of rail 76, but because of the shortened or truncated nature of rail 76 these lines of force do not significantly sense that longitudinal portion of strings 10.

As a result, the width or aperture of the magnetic field that is applied to strings 10 by the pickup of FIG. 4 is indicated by horizontal arrows above the strings and the letter "A" for aperture, and it will be noted that this magnetic field aperture is approximately the same width as that for the conventional single coil pickup of FIG. 1. This result is very significant because it means that pickup 70 of FIG. 4 senses the vibration of only a very short length of string 10, just as did the single-coil pickup of FIG. 1. At the same time, the pickup of FIG. 4 may be made small enough to be received in a cavity that was designed for a single-coil pickup.

It will be understood that if the cross-sectional view of FIG. 4 were taken in the other end portion of the pickup 70, it would then show a different set of the pole pieces, with the rail 74 shortened or truncated while the rail 76 would appear in full height. The magnetic field is then distorted in the same manner, but centered on rail 76 rather than on rail 74.

Figure 5:
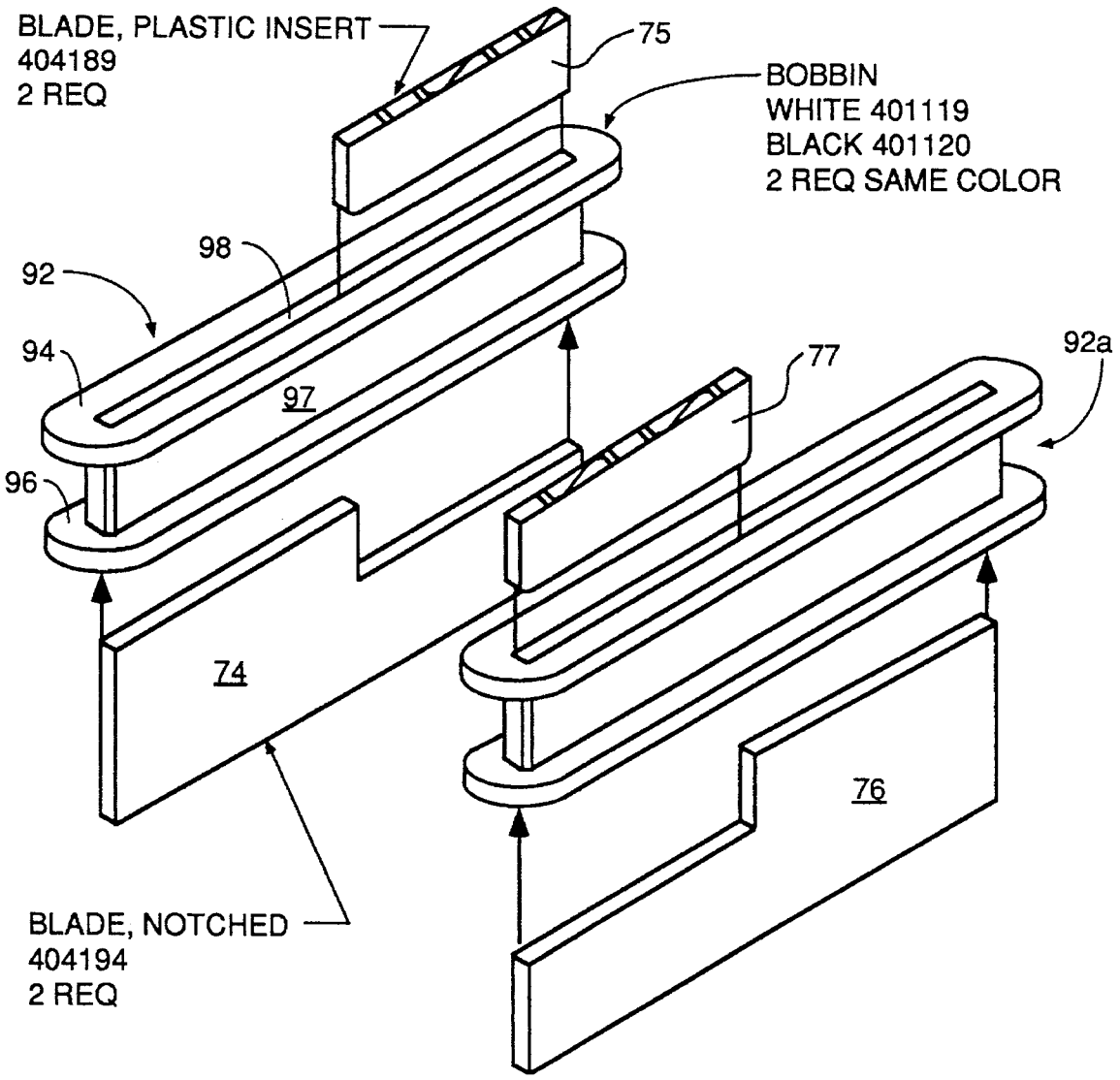
FIG. 5 is an exploded perspective view of structural components of the humbucker pickup of FIGS. 4 and 7.
Figure 6:
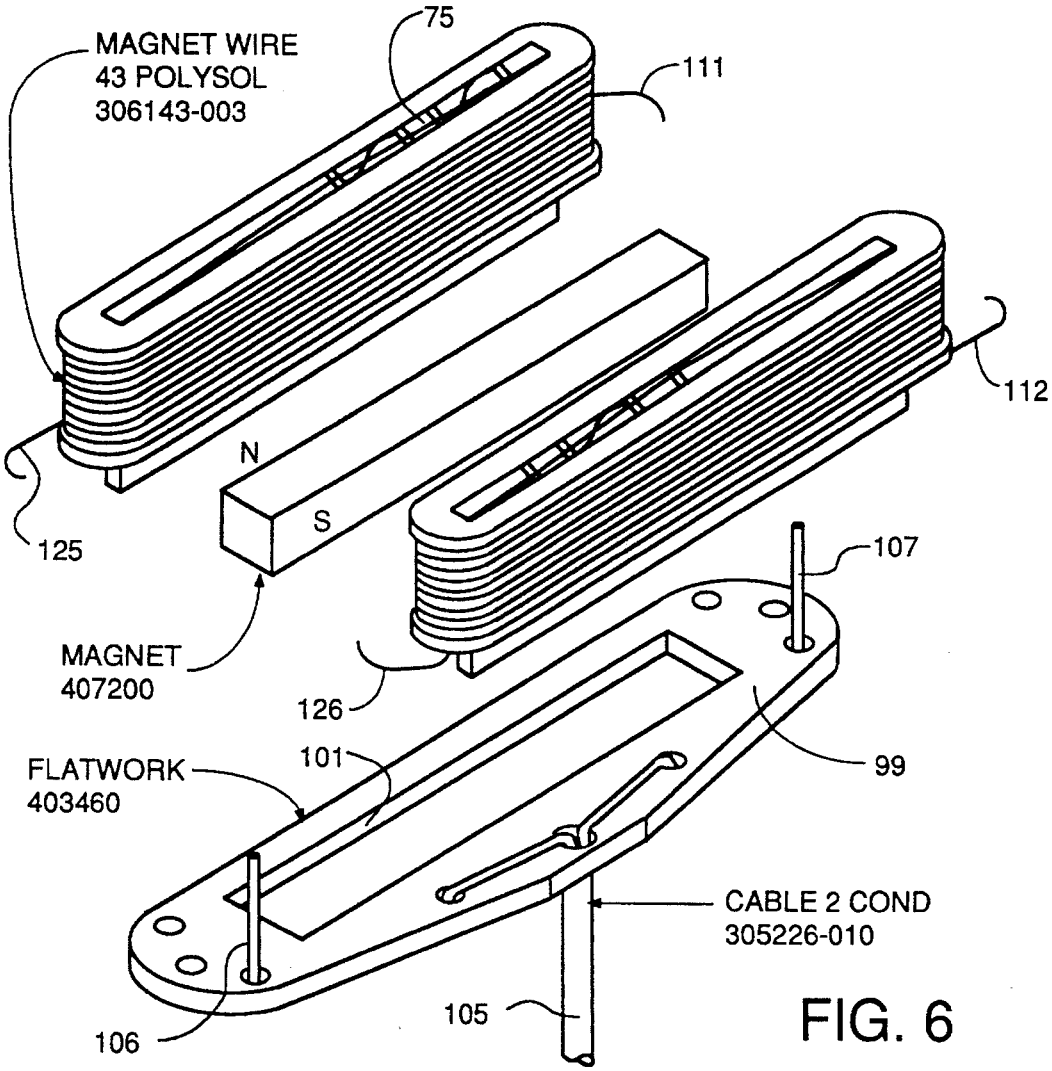
FIG. 6 is an exploded perspective view of the humbucker pickup of FIGS. 4 and 7 in a partly assembled form.
Figure 7:
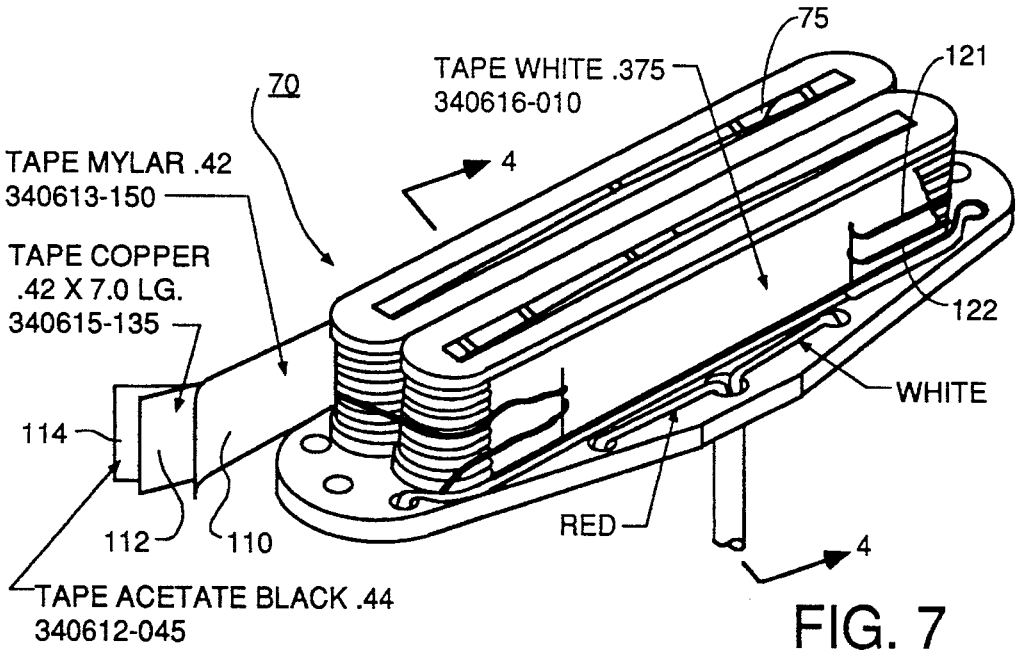
FIG. 7 is a perspective view of the humbucker pickup of the present invention in its assembled configuration.

Reference is now made to FIGS. 5, 6, and 7 which show structural details of the pickup 70, and particularly to FIG. 5. A pair of identical bobbins 92, 92*a* support the coils 78, 80, and the rails 74, 76. Each bobbin is integrally formed of an electrical insulating and non-magnetic material such as a polycarbonate material sold under the trademark LEXAN. The cross-section of each bobbin is essentially in the form of a capital "I". Thus the bobbin 92 includes a flat upper shelf 94, a flat lower shelf 96, and a vertical web 97 that interconnects the shelves. The vertical web 97 has a cavity 98 throughout most of its length. The configuration of cavity 98 is such as to receive a corresponding one of the rails 74, 76.

As shown in FIG. 4 the upper edge of rail 74 projects some distance above the upper shelf of the corresponding bobbin. The lower edge of the rail 74 extends through the cavity 98 and below the bobbin by a distance equal to about half the height of the bobbin. Magnet 72 is positioned underneath both bobbins and fills the lateral space between the plates or rails. A flat supporting base member 99 made of a non-magnetic electrical insulating material supports the lower surfaces of the bobbins on the outer sides of the rails.

As best seen in FIG. 5, a pair of bobbins 92, 92*a* are used for mounting the coil assemblies. The core structure for each coil assembly includes an elongaged flat rail or plate 74 or 76 of cold rolled steel having a high ferrous content, which is reduced in height for about half its length. In the assembled configuration as shown in FIGS. 6 and 7, a non-magnetic plastic insert 75 or 77 fills the space resulting from the height reduction in rail 74 or 76. The core structures are disposed parallel to each other with the non-magnetic core inserts at opposite ends of the core structures in the upper portions thereof.

As a result of this arrangement, one end portion of each core structure is close to the strings of the instrument while the other end portion is remote therefrom. The tall portion of one core structure is adjacent the low or short portion of the other core structure, and vice versa.

More specifically, the core structures are placed in their respective bobbins and the respective coils 78, 80, are wound about the bobbins. The bobbins are placed upon the elongated bottom plate 99 which is made of electrical insulating and non-magnetic material. Bottom plate 99 has a central opening 101 therein. The bobbins are placed upon the bottom plate in a parallel relationship with rails 74, 76, projecting through the central opening 101. The elongated, transversely polarized permanent magnet 72 is disposed in parallel relationship to both of the coils, with one side of the magnet forming a magnetic path with one core structure and the other side thereof forming a magnetic path with the other core structure.

As shown in FIG. 4, the core or rail 74 extends well above the bobbin 92 while the upper edge of rail 76 extends through only about half the height of bobbin 92*a*. For convenience in illustration the plastic insert 84 filling the space above rail 76 is not shown. It will be understood that were a cross-section view taken in the other end of the pickup the rail 74 will be only about half the height of bobbin 92 while rail 76 will extend well above bobbin 92*a*.

FIGS. 6 and 7 show the electric circuit connections for a single pickup. An electrostatic shield 112 is provided by a copper tape wrapped about the outside of the entire assembly including both coils, and which is protected by layers of insulating tape 110, 114, as indicated in FIG. 7. A two-conductor output cable 105 includes a red or hot wire 106 and a white or ground wire 107. The input end wires 121, 122 for the two coils are connected outside the tape 114 to ground wire 107 while their output end wires 115, 116 are connected to the output signal wire 106. A connection, not specifically shown, is made from electrostatic shield 112 to ground lead 107. Soldered connections, not specifically shown, are also made from each of the rails 74, 76 to the ground lead 107, to keep this portion of the magnetic circuit electrically neutral.

The two coils 78, 80, are wound in the same direction but are connected in parallel and electrically out of phase for cancelling external noise signals. The arrangement of the single magnet 72 establishes an opposite sense for the magnetic circuits of the two coils so that the music signals magnetically created in the two coils are added together. In terms of their impedance, the two coils are in parallel, providing a combined impedance which is half that for an individual coil.

The pickup 70 of the present invention is preferably of such length as to extend underneath six strings of a guitar. The tall portion of pole piece 74 is then close to three of the strings and the tall portion of pole piece 76 is close to the other three.

Although the presently illustrated embodiment of the invention utilizes core plates 74, 76, whose length is sufficient to comprehend all six strings of a guitar, it will nevertheless be understood that the principle of the invention may be applied to a different number of strings. For example, if only two strings are involved, each core structure will have one tall pole piece and one short pole piece, with the tall pole piece of each core structure being aligned adjacent the short pole piece of the other.

Figure 8:
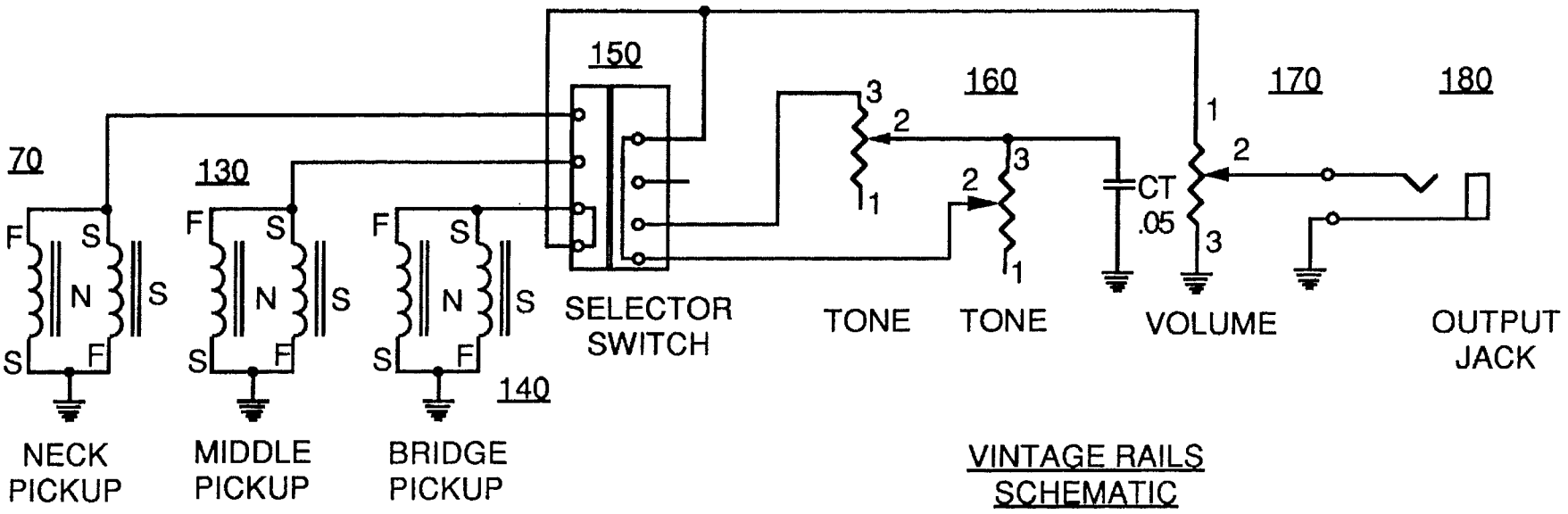
FIG. 8 is a schematic wiring diagram of the humbucker pickup of FIGS. 4 and 7.

The objective of the present invention is to provide music signals of desired characteristics to an output circuit. It has been found that the parallel connection of the two coils of the pickup, as shown in FIGS. 7 and 8, provides a different musical result than if the two coils are connected in series. This result is superior, at least from one point of view, and for that reason I can say that the parallel connection of the coils as shown has a definite advantage.

Although the core structures are presently illustrated as being in the form of flat metal rails, it will be understood that the principle of pairing one tall pole piece with one short pole piece to provide a narrow magnetic field aperture for the strings may be applied to other types of pole structures.

As presently illustrated each of the rails or core structures 74, 76, has its height reduced for about half its length. The length of the reduced-height portion need not be either exactly or approximately half the length of the rail so long as it is the same for both rails or core structures, so that a balanced impedance of the two coil assemblies will be achieved.

Nor is it essential that the height reduction of the core structure or rail be either precisely or approximately half. As long as one pole piece of the pair is deliberately made short in comparison to the other, the effect of narrowing the magnetic field aperture applied to the strings will be achieved.

It is also possible for one end of each core structure to consist entirely of a non-magnetic insert or "fill-in" member, with no metal pole piece beneath it. That arrangement is believed to be less satisfactory than the arrangement here shown, however, because the level of output signal produced may be too low.

According to the presently preferred embodiment of the invention an emphasis is placed on the close or distant spacing of each pole piece from the associated string, but alternatively a similar effect may be achieved by placing a high reluctance portion of one core structure adjacent a low reluctance portion of the other core structure.

FIG. 8 illustrates the complete electrical system for a guitar when a set of three separate pickups in accordance with the presently preferred embodiment of the invention are used. As shown in FIG. 8, a first pickup 70 is used at the neck location of the instrument; a second pickup 130 is the middle pickup; and a third pickup 140 is located near the bridge of the instrument. In each pickup the start end S of each coil is connected to the finish end F of the other coil. A manual selector switch 150 allows the performer to select a particular pickup to feed the music signal through tone control 160 and volume control 170 to an output jack 180.

Figure 9:
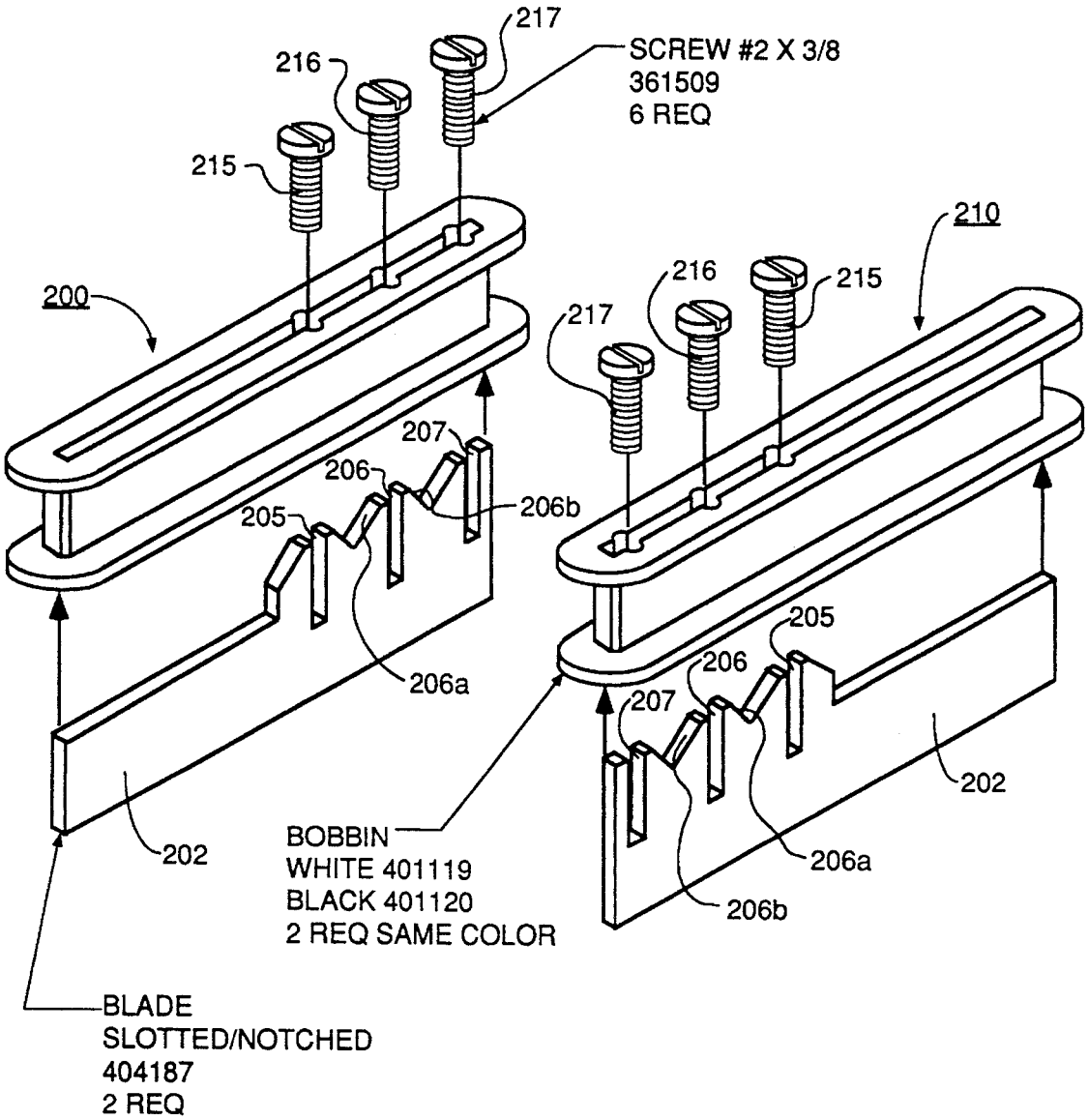
FIG. 9 is a perspective view of a modified form of the invention.

In the embodiment of FIG. 9 the bobbins 200, 210 are like those previously described. Each of two identical plates 202 has slots 205, 206, 207 therein to receive adjustable screws or pole pieces 215, 216, 217. It will be particularly noted that at the slot 206 the plate 202 is angled away from both sides of the slot at 206*a*, 206*b*, so as to diminish the mass of the magnetizable material adjacent to the associated screw and thereby concentrate the magnetic field more strongly in the screw. In the fully assembled form of the pickup, the magnet 72 engages the lower inside surfaces of both of the plates 202, as in the prior embodiment.

While a presently preferred embodiment of the invention has been disclosed in detail in order to comply with the patent laws, it will be understood that the scope of the invention is not thus limited, and is to be measured only in accordance with the appended claims.

What I claimed is:

1. In a humbucking pickup for an electric guitar including a matched pair of elongated coil assemblies placed closely in parallel, an electrical circuit connecting the two coils with opposing electrical polarities so that external noise signals are cancelled, and the two coils having magnetic circuits arranged so that the music signals magnetically created in the two coils are added, an improvement for narrowing the magnetic field applied to the strings of the instrument, comprising:

each of the two coils having an associated vertically oriented core structure that includes a horizontally elongated metal core plate which has a reduced height for half its length, and a non-magnetic member occupying the space otherwise left from that height reduction;

the two core structures being disposed in parallel but with the reduced height portions of their core plates being at opposite ends; and said pickup being adapted to be placed under the strings of the guitar with one end of each core structure extending close to the strings while the associated end of the other core structure does not.

2. A humbucking pickup as in claim 1 which further includes an elongated, transversely polarized permanent magnet disposed between said core plates and engaging the lower longitudinal edges of both of said elongated metal core plates.

3. A humbucking pickup as in claim 2 wherein each of said core plates is vertically oriented and is reduced to half its height for half its length.

4. A humbucking pickup for an electric guitar as in claim 2 including a non-magnetic frame supporting said magnet and said core structures, said non-magnetic support frame including an elongated bottom plate having an elongated central opening which receives the lower longitudinal edges of said core structures with said magnet therebetween.

5. A humbucking pickup as in claim 2 which further includes a plurality of adjustable pole pieces adjustably secured to corresponding ones of said metal core plates, each said pole piece being in the form of a metal screw that engages a vertical slot in the corresponding metal core plate.

6. A humbucking pickup as in claim 5 wherein each said screw has an exposed head for adjusting the depth to which the screw occupies the slot, and the longitudinal edge of the core plate is angled away from both sides of the slot so as to diminish the mass of the magnetizable material adjacent to the screw and thereby concentrate the magnetic field more strongly in the screw.

7. A humbucking pickup as in claim 2 wherein said two coils are electrically connected in parallel.

8. In a humbucking pickup for an electric guitar, the sub-assembly comprising:

an elongated, transversely polarized permanent magnet;

two pairs of relatively tall pole pieces and two pairs of relatively short pole pieces, one end of the tall pole pieces of one pair and one end of the short pole pieces of one pair engaging opposite sides of one end of said magnet, and one end of the tall pole pieces of the other pair and one end of the short pole pieces of the other pair engaging opposite sides of the other end of said magnet;

the tall pole pieces on each side of said magnet being formed by a single elongated plate which is reduced in height to form the associated short pole pieces; and a pair of substantially identical pickup coils, each wound about a corresponding elongated plate on one side of said magnet so that said coils are magnetized in opposing polarity, and so that the magnetic field generated from each set of two oppositely arranged pole pieces is concentrated adjacent the coil that is wound about the tall pole piece of that set.

9. The sub-assembly of claim 8 wherein each of said tall pole pieces is formed by a metal plate having a slot therein, and a metal screw that adjustably engages said slot.

10. In a humbucking pickup for an electric guitar including a matched pair of elongated coil assemblies placed closely in parallel, an electrical circuit connecting the two coils with opposing electrical polarities so that external noise signals are cancelled, and the coils having magnetic circuits arranged so that the music signals magnetically created in the two coils are added, an improvement for narrowing the magnetic field applied to the strings of the instrument, comprising:

each of the two coils having an associated core structure that includes a vertically oriented and horizontally elongated metal core plate which on one end portion thereof has its upper longitudinal edge reduced to partial height;

said core structures being disposed in parallel with the lower longitudinal edges of said elongated metal core plates extending in parallel relationship below the associated coils, and the spaces resulting from said reduced height of said core plates being at opposite ends of said core structures; and an elongated, transversely polarized permanent magnet disposed below both of said coils and engaging the lower longitudinal edges of both of said elongated metal core plates.

11. A humbucking pickup as in claim 10 wherein said two coils are electrically connected in parallel.

12. A humbucking pickup as in claim 10 which further includes a plurality of adjustable pole pieces adjustably secured to corresponding ones of said metal core plates, each said pole piece being in the form of a metal screw that engages a vertical slot in the corresponding metal core plate.

13. A humbucking pickup as in claim 12 wherein each said screw has an exposed head for adjusting the depth to which the screw occupies the slot, and the longitudinal edge of the core plate is angled away from both sides of the slot so as to diminish the mass of the magnetizable material adjacent to the screw and thereby concentrate the magnetic field more strongly in the screw.

14. In a pickup for an electrical instrument that includes an elongated flat metal core plate having a longitudinal edge with a slot therein that extends transversely for part of the width of the core plate, and a screw forming a pole piece adjustably seated in said slot and having an exposed head for adjusting the depth to which the screw occupies the slot, the improvement comprising:

the longitudinal edge of the core plate being angled away from both sides of the slot so as to diminish the mass of the magnetizable material adjacent to the screw and thereby concentrate the magnetic field more strongly in the screw.

* * * * *